US007125370B1

(12) United States Patent
Schaffner et al.

(10) Patent No.: US 7,125,370 B1
(45) Date of Patent: Oct. 24, 2006

(54) EXERCISE APPARATUS

(75) Inventors: Grant Schaffner, League City, TX (US); Jason R. Bentley, Kemah, TX (US); James A. Loehr, Houston, TX (US); Daniel P. Gundo, San Jose, CA (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 286 days.

(21) Appl. No.: 10/845,608

(22) Filed: May 12, 2004

(51) Int. Cl.
*A63B 26/00* (2006.01)

(52) U.S. Cl. ..... 482/142; 482/148; 482/72

(58) Field of Classification Search ..... 482/142, 482/148, 70–72; D21/676, 686, 690, 674
See application file for complete search history.

(56) References Cited

U.S. PATENT DOCUMENTS

| | | | | |
|---|---|---|---|---|
| 1,548,849 A | | 8/1925 | Ruden et al. | |
| 2,733,922 A | | 2/1956 | Diego | |
| 3,219,341 A | | 11/1965 | Weinstein | |
| 4,176,836 A | | 12/1979 | Coyle | |
| 4,316,608 A | * | 2/1982 | Lundberg | 482/94 |
| 4,333,644 A | | 6/1982 | Lambert, Jr. et al. | |
| 4,511,137 A | | 4/1985 | Jones | |
| 4,535,985 A | | 8/1985 | Mask | |
| 5,158,513 A | | 10/1992 | Reeves | |
| 5,263,913 A | | 11/1993 | Boren | |
| 5,312,315 A | | 5/1994 | Mortensen et al. | |
| 5,411,458 A | | 5/1995 | Giust | |
| 5,616,107 A | * | 4/1997 | Simonson | 482/97 |
| 5,628,632 A | | 5/1997 | Doane | |
| 5,860,899 A | | 1/1999 | Rassman | |
| 5,941,803 A | | 8/1999 | Chamberlain et al. | |
| 6,527,685 B1 | | 3/2003 | Endelman et al. | |

* cited by examiner

*Primary Examiner*—Lori Amerson
(74) *Attorney, Agent, or Firm*—Theodore U. Ro

(57) ABSTRACT

An apparatus and method for exercising whereby the user is supported by various mechanisms in such as way that the user's shoulder area is free to translate and rotate; the user's pelvic area is free to translate and rotate; or in any combination.

26 Claims, 8 Drawing Sheets

EXERCISE APPARATUS

GOVERNMENT INTERESTS

Origin of the Apparatus

The various embodiments of the apparatus and methods for use described herein were made by employee(s) of the United States Government and under contract with the United States Government and may be manufactured and used by or for the Government of the United States of America for governmental purposes without the payment of any royalties thereon or therefore.

BACKGROUND

1. Field of Invention

This invention generally relates to an exercise device. This invention more particularly relates to an exercise device that closely simulates a free-weight squat movement.

2. Background

Many of a person's daily events require the use of the lower body involving multiple muscle groups across multiple joints. For example, walking, running, climbing stairs, sitting or standing, bending down to pick up a child or an object etc. all involve multiple joint movements. Since these activities mainly involve the lower body and because they all involve multiple muscle groups across multiple joints, the optimal exercise for maintaining or increasing strength for daily activities of living should involve multiple muscles across multiple joints. In addition, most of these activities require balance to prevent tripping and falling. The exercise that most closely mimics or involves all of the same muscle groups and joints while increasing the stability of the body is the squat exercise.

The free-weight squat exercise is an important exercise because it is a triple-extension movement that requires use of multiple major muscle groups (e.g., the quadriceps, hamstrings and hip musculature) over three different joints (e.g., hip, knee and ankle) to operate in unison to complete the movement. The free-weight squat is performed while standing in an upright posture with weight resting over the upper back and shoulders. The ability to move the hips backward is what allows the exercise to incorporate the hip and hamstring muscles. This same movement is what also allows the smaller stabilization muscles of the abdomen, lower back, hip rotators, and calf to be used. Incorporation of so many muscle groups over multiple joints allows a person to increase strength of the entire lower body and is considered the optimal method to strengthen the lower body. The squat exercise also requires the body to use the smaller musculature of the abdomen and back to stabilize the body at the trunk as well as the calf musculature to stabilize the knee and the ankle joints. The use of the smaller stabilization muscles allows an increase in balance creating a more stable base. The squat exercise is safe and effective as long as it is performed correctly. A drawback to the performance of this exercise is that in order to perform it correctly a person needs to be instructed by a knowledgeable professional who can train them on the proper technique for the performance of the exercise and carefully watch them over multiple sessions to ensure the technique is continually performed correctly. The squat movement also allows for large amounts of weight to be lifted while performing the exercise. If a person were to perform the exercise incorrectly or fall, the weight could cause injury to the person. Since this exercise requires so many muscle groups across three separate joints, there is a wide margin within which a person could perform the technique incorrectly resulting in injury, if not properly instructed or supervised.

Many different types of leg exercise devices have been developed for use in the field of strength training, physical therapy and rehabilitation, and the like. More particularly, many different types of leg exercise devices that attempt to simulate a free-weight squat movement have been developed. These different types of leg exercise devices may be organized into two primary groups. The first group of devices utilizes an immovable upper back and shoulder support sled guided along two support rails. See U.S. Pat. No. 4,535,985 to Mask, U.S. Pat. No. 5,263,913 by Boren, and U.S. Pat. No. 5,941,803 by Chamberlain, et. al. Generally, in these devices, the user will push his/her feet against a foot plate thereby moving the user's upper back and shoulders on a sled along a fixed longitudinal axis defined by the device's support rails. In these devices, the only degrees of freedom allowed are flexion and extension of the user's hips, knees, and ankles. These devices do not allow the pelvis to translate freely out of plane as in a classic free-weight squat movement. Since the user's shoulders and pelvis cannot move independently, the squat motion performed does not recruit the user's back musculature to stabilize the user's upper torso. The second group of devices utilize curved path defined by a track frame. See U.S. Pat. No. 4,176,836 to Coyle and U.S. Pat. No. 5,411,458 to Giust. There are two major constraints inherent in the second group of devices. The first major constraint is that the user's pelvis, back, and shoulders, are all supported by the same rigid sled. The user's pelvis cannot move independently from the user's shoulders and thus the user's back musculature is not recruited to stabilize the user's upper body. The second major constraint is that the rigid sled is required to move along a predefined path defined by the track system. As a result, the user's upper body and leg joints are prevented from assuming the user's natural positions and form, which are inherent in a free-standing squat movement in which the user's upper body is free to move to whatever positions achieves a natural balance with respect to the user's feet. Another constraint of these devices is that they do not provide a means whereby a resistive force can be applied along the line of action perpendicular to the plane defined by the foot plate. In other words, these devices do not show how a resistive force can be applied along the same line of action with respect to that body as would be the case with gravity acting on a weighted barbell, as in a free-standing squat movement.

The present invention seeks to provide an apparatus that supplies additional advantages over the prior art and takes into account the aforementioned considerations.

SUMMARY OF INVENTION

The apparatus describe herein provides support for a user engaged in a variety of resistive exercises. In one embodiment, the user is in a substantially horizontal orientation and supine position. The unique features and versatility of the various embodiments of the apparatus described herein promise to be useful in bed-rest studies, strength training, physical therapy and rehabilitation, and the like. The various embodiments of the apparatus afford a capability for selectively loading and unloading of portions of the user's body through its support mechanisms, so that specific parts of the user's body can be trained with little or no effect on other parts that may be disabled or in the process of recovery from injury. Thus, the various embodiments described herein are useful for rehabilitation exercise programs prescribed by physicians and physical therapists. The capability for selective loading and support also offers potential benefits to strength and conditioning trainers and athletes who wish to selectively strengthen selected parts of their bodies.

In some embodiments described herein, the apparatus supports the user's weight while enabling the user to perform an exercise that closely approximates a free-weight standing squat exercise. Some embodiments described herein include mechanisms that support the user in such a way that the hips are free to translate both horizontally and vertically relative to a surface, such as a floor, and are free to rotate about the line connecting the hips. In some embodiments described herein, the shoulders are free to translate horizontally relative to the surface while the upper back is free to rotate about the line connecting the shoulders.

Among the mechanisms for hip motion and support is a counterbalance force component or counterbalance force means that offsets the weight of the user as the user's pelvis translates horizontally and vertically as well as rotates the pelvis about the line connecting the hips. In an embodiment, the counterbalance force component is coupled to a pelvic sled wherein the pelvic sled allows the pelvic and hip movements. The user is also supported at his/her shoulder by a mechanism as part of a shoulder sled that can tilt to provide continuous support of the user's upper back while allowing the rotation required for arching the user's back as the user's pelvis is displaced. In an embodiment, the shoulder sled also affords a capability for horizontal motion relative to the surface, and acts as the point of attachment of a resistive load that is provided for a variety of leg exercise, including the squat movement. In another embodiment, a foot plate affords a capability for horizontal motion relative to the surface, and acts as the point of attachment of a resistive load that is provided for a variety of leg exercise, including the squat movement. The apparatus is compatible with any resistive load component that provides bi-lateral movement via, for example, a moving cable or other suitable mechanical linkage.

In an embodiment, the hip-translation, shoulder-translation, and shoulder-rotation degrees of freedom of the supports can be locked individually or in any combination to support the user as necessary for exercises other than a free-weight squat movement. If necessary, for such exercises, the resistive load can be applied directly to the user by use of various attachments. Such exercises include, for example, a heel raise, upright row, leg press, leg curls, extension of triceps, front raise, lateral raise, and rear raise.

DESCRIPTION

DETAILED DESCRIPTION OF THE INVENTION

The present apparatus and methods for use will now be described more fully hereinafter with reference to the accompanying drawings, in which embodiments of the invention are shown. This apparatus may, however, be embodied in many different forms and should not be construed as limited to the embodiments set forth herein; rather, these embodiments are provided so that this disclosure will be thorough and complete and will fully convey the scope of the apparatus to those skilled in the art. Like numbers refer to like elements throughout.

The word "about" as used herein may be applied to modify any quantitative representation that could permissibly vary without resulting in a change in the basic function to which it is related. For example, a quantitative time period as disclosed herein may permissibly be different than the precise value if the basic function to which the time period is related does not change. The words "generally" and "substantially" as used herein are used to indicate acceptable variance in a physical configuration of a component so long as the variance doesn't change the basic function to which a component is related. The term "longitudinal translation" or any form thereof as used herein is defined as movement along an axis extending from a user's head to his/her feet. The term "vertical translation" or any form thereof as used herein is defined as movement along an axis perpendicular to the axis defining a longitudinal translation and extending from a user's back to his/her stomach. For the purposes herein, exercise is defined has any activity that requires some level of physical exertion.

Figure 1A:
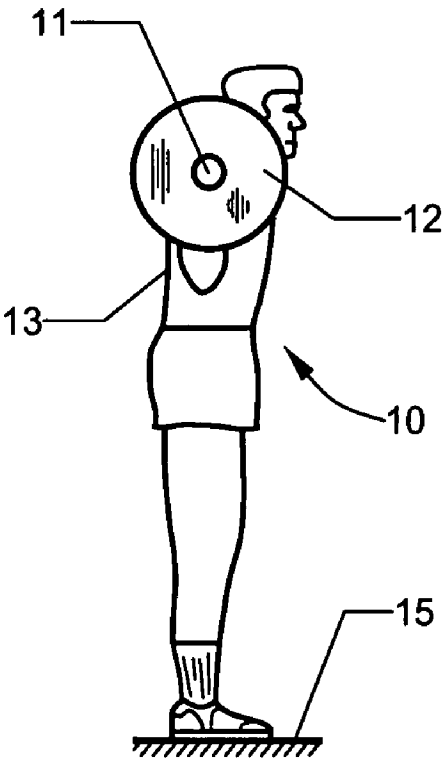
FIG. 1A (PRIOR ART)
FIGS. 1A, 1B, and 1C are diagrammatic representations illustrating a free-weight squat exercise as performed according to the prior art, i.e., an exerciser using a barbell with weights.
Figure 1B:
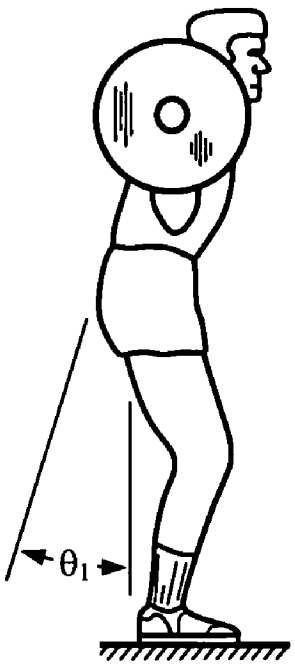
FIG. 1B (PRIOR ART)
Figure 1C:
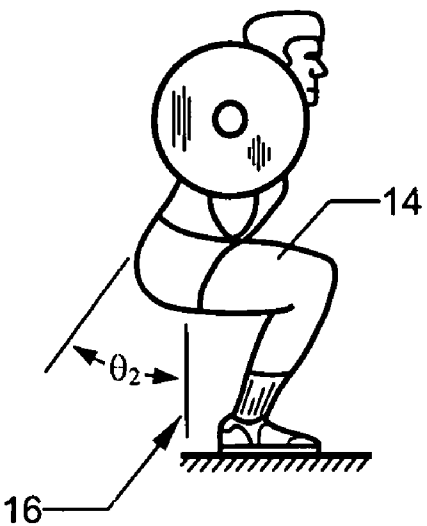
FIG. 1C (PRIOR ART)

A free-weight squat exercise is performed in accordance with the prior art as shown FIGS. 1A, 1B, and 1C. An exerciser (10) lifts a barbell (11) carrying weights (12) and initially stands in an upright position. The exerciser's upper back (13) is substantially straight as shown in FIG. 1A. It will be understood that the squat movement can be performed with or without weights and will be described herein for purposes of illustration as being performed with weights.

The squat exercise progresses when the exerciser (10) begins to descend by bending his/her legs at the knees. The exerciser's back deviates from a perpendicular axis relative to a supporting surface or upright axis (16) by the angle $\theta_1$. A particular intermediate position of the exerciser performing the squat exercise is shown in FIG. 1B.

The squat exercise progresses until the exerciser's thighs (14) are substantially parallel to the supporting surface (15) on which the exerciser stands. With the thighs in this position, the angle of the exerciser's upper back (13) from the upright axis (16) increases to $\theta_2$.

Thus, when performing a squat exercise in accordance with the proper technique, the exerciser's back does not remain straight as the exerciser descends. The exerciser's back actually tends to increase in angularity from the upright axis (16) as the exerciser's descent progresses. Further, the exerciser's pelvis moves independently of the exerciser's upper back and the exerciser's back musculature is recruited to stabilize the exerciser's upper body. Still further, the resistive force captured in the barbell (11) and weights (12) is continuously applied along the upright axis (16) as defined by gravity. Finally, the angularity path (i.e., change in the angle θ as illustrated in FIGS. 1B and 1C) an exerciser experiences through the course of the squat exercise is unique to each exerciser and dependent on specific characteristics of each exerciser. The present apparatus and its various embodiments accommodate these advantageous elements.

The present invention, as defined by the various embodiments described herein, is also advantageous over the prior art free-weight squat exercise as shown in FIGS. 1A, 1B, and 1C in that the risk of injury to the exerciser's back and knees is greatly reduced because the various embodiments of the present apparatus support the exerciser's upper back continuously during the course of an exercise. Moreover, a safety feature is involved in the various embodiments of the present apparatus to the extent that the exerciser will not have to try to balance weights on a barbell or risk tripping on some object when trying to put the barbell back on a rack. Further, the guide rails of the apparatus eliminate the risk of the exerciser falling over to his/her left or right sides as could happen with a free weight squat.

Figure 2B:
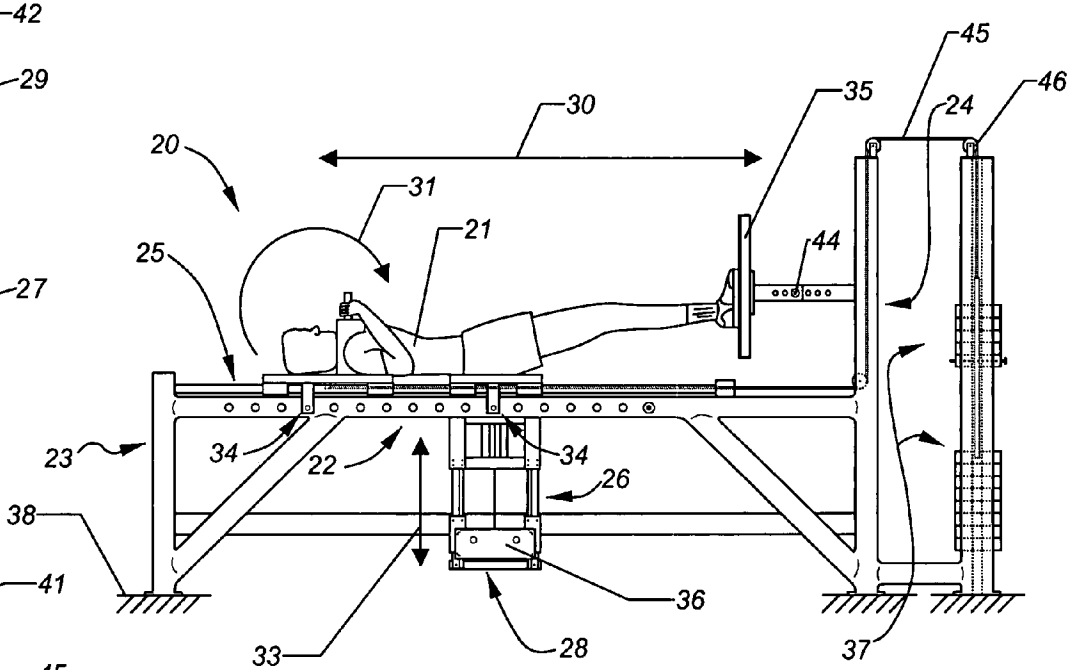
FIGS. 2A and 2B are diagrammatic representations of a top view and side view, respectively generally illustrating as an example, an embodiment of the apparatus showing a user disposed thereon in one stage of a squat exercise.
Figure 2A:
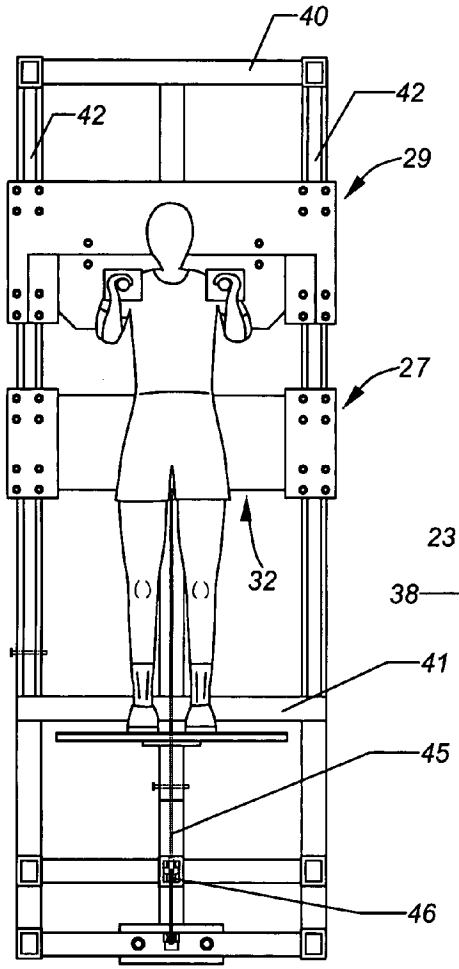

An exercise apparatus (20) in accordance with an embodiment of the present invention is illustrated in top and side views in FIGS. 2A and 2B, respectively. In this particular embodiment, the exercise apparatus (20) supports a user (21) in a supine position. The exercise apparatus includes a surface engaging substantially rectangular base frame (22) having a front end (23) and rear end (24). A primary track frame (25) is supported by the base frame (22) between the front end (23) and rear end (24) of the base frame (22). A secondary track frame (26) is disposed on the primary track frame (25) so that the secondary track frame (26) can reciprocally move between the front end (23) and rear end (24) of the base frame (22) in longitudinal translation (30). The secondary track frame (26) has a top end (27) and a bottom end (28). A shoulder sled (29) is disposed on the primary track frame (25) so that the shoulder sled (29) can reciprocally move between the front end (23) and rear end (24) of the base frame (22) in longitudinal translation (30) and wherein the user's shoulders engage the shoulder sled (29). Therefore, when the user (21) is exercising, the shoulder sled (29) allows longitudinal translation (30) of the user's shoulders and upper back between the front end (23) and rear end (24) of the base frame (22). Still further, the shoulder sled (29) allows rotation (31) of the user's shoulders and upper back relative to the base frame (22) as specifically illustrated in FIG. 3B. A pelvic sled (32) is disposed on the secondary track frame (26) so that the pelvic sled (32) can reciprocally move between the top end (27) and bottom end (28) of the secondary track frame (26) in vertical translation (33). The combined motion of the pelvic sled (32) and the secondary track frame (26) allows the user's hips to freely move in both longitudinal (30) and vertical (33) translation. The rotation (31) described above is about an axis extending from the user's right side to the user's left side. In other words, in a classic three-dimensional Cartesian coordinate system, the axis extending from the user's right side to the user's left side completes the 3-axes system wherein the other 2 axes are the longitudinal (30) and vertical (33) axes. For the purposes herein, the axis extending from the user's right side to the user's left side will be referred to as the latitudinal axis. Multiple embodiments exist relative to the rotation of the shoulder sled. For example, in another embodiment, rotation of the shoulder sled is not limited to rotation about the latitudinal axis. In yet another embodiment, the shoulder sled freely rotates about a plurality of axes, wherein the central axis is the latitudinal axis.

With continued reference to the specific embodiment illustrated in FIGS. 2A and 2B, the exercise apparatus (20) also includes an adjustable counterbalance force component (36) supported by the secondary track frame (26) and coupled to the pelvic sled (32) so that the counterbalance force component (36) is adjustable to be commensurate with the portion of the user's weight not supported by the shoulder sled and foot plate (35). Further, the counterbalance force component (36) offsets the user's weight as the user's hips move on the pelvic sled (32) and secondary track frame (26) in longitudinal (30) and vertical (33) translation. A foot plate (35) is supported by the base frame (22) near the rear end (24) so that the user's feet engage the foot plate (35) and so that the shoulder sled (29), the secondary track frame (26), and the pelvic sled (32) are all displaced upon the user pushing with his/her feet against the foot plate (35). An adjustable exercise resistive force component (37) is supported by the base frame (22) and coupled to the shoulder sled (29) so that the adjustable exercise resistive force component (37) enables an exercise force commensurate with the strength of the user (21) and the desired intensity of the exercise being performed. The adjustable exercise resistive force component (37) may be coupled to the shoulder sled (29) through a variety of means commonly known in the art and discussed later.

The base frame (22), primary track frame (25), secondary track frame (26), shoulder sled (29), pelvic sled (32), foot plate (35), adjustable counterbalance force component (36), adjustable exercise resistive force component (37), and associated connectors and couplings will be more fully described below.

With continued reference to the embodiment illustrated in FIGS. 2A and 2B, the base frame (22) is a substantially rectangular frame comprising a plurality of interconnected elongated members. The elongated members are interconnected by welding, mechanical attachment, bonding, or other suitable means. The base frame (22) engages a surface (38). Although a substantially rectangular frame is illustrated in FIGS. 2A and 2B, all other shapes may be utilized such that a user can translate in at least a longitudinal (30) and vertical (33) motion relative to the base frame. In addition, although the longitudinal axis of the base frame (22) is parallel with the surface, the longitudinal axis of the base frame (22) may be perpendicular with the surface or inclined at any angle relative to the upright axis wherein the upright axis is an axis perpendicular with and extends out of the surface (38). Further, the base frame (22) may include rollers (not otherwise shown) or other means to reduce friction at the point of engagement of the base frame (22) with the surface (38). Such rollers (not otherwise shown) or other means to reduce friction at the point of engagement with the surface (38) may be lockable to prevent movement when the base frame (22) is at a desired location.

With continued reference to the embodiment illustrated in FIGS. 2A and 2B, the primary track frame (25) includes a pair of elongated, horizontally disposed primary track members (42) in parallel space relation. A plurality of primary track members may be employed. Multiple embodiments for the size and shape of the primary track members exist. For example, a generally rectangular cross section is used in FIG. 4A. In another example, a generally spherical cross section is used in FIG. 5A. Any size and shape can be employed such that the functionality of the primary track members remains. The longitudinal axis (30) of the primary track frame (25) may be disposed perpendicular to the surface or at any angle relative to the vertical axis. For example, in one embodiment (not otherwise shown), the longitudinal axis is perpendicular to the surface and an apparatus for supporting a user comprises a primary track frame comprising a plurality of longitudinal tracks and a shoulder sled assembly disposed on the primary track frame so that the shoulder sled assembly reciprocally moves along the primary track frame and wherein the shoulder sled assembly is rotatable. The disposition of the primary track frame may be aligned with or independent to the base frame. For example, in an independent configuration, if the base frame's longitudinal axis is substantially parallel with the upright axis, the primary track frame may comprise an inclined section relative to the base frame. In FIGS. 2A and 2B, the primary track frame (25) is aligned with the base frame (22) and is in parallel space relation with the base frame's longitudinal axis wherein the base frame's longitudinal axis is substantially parallel to the surface (38). Again, the above examples illustrate the variety of embodiments that can be employed relative to the positioning of the base frame and primary track frame. The primary track frame (25) may further comprise a front cross-bar (40) and rear cross-bar (41) supported by the base frame wherein the front and rear cross bars extend across the front and rear ends of the primary track members (42) to support and rigidly separate the primary track members as well as to prevent the secondary track frame from sliding beyond the limits of the primary track frame (25). The primary track frame (25) may also further comprise a locking means (34) for locking the shoulder sled (29), pelvic sled (32), or both at a predetermined position relative to the primary track frame (25) to prevent longitudinal motion relative to the base frame (22), to support a selected resistive load, or both. The locking means (34) illustrated in FIG. 2B is comprised of a plurality of apertures on the base frame (22), a first latch attached to the shoulder sled (29), a second latch attached to the secondary track frame (26), and a first and second locking pin (not otherwise shown). In another embodiment, the locking means comprises a plurality of apertures on the base frame (22), a first and second spring-loaded latch and pin assembly (not otherwise shown) attached to the shoulder sled (29) and secondary track frame (26), respectively. In a third embodiment, the locking means comprises a plurality of apertures on the base frame (22), and a first and second screw thread arrangement actuated by a knob (not otherwise shown) attached to the shoulder sled (29) and secondary track frame (26), respectively. Thus, multiple embodiments exist for the locking means. The primary track means and primary track frame are track means for supporting a reciprocally moving device. In another embodiment (not illustrated), the primary track frame includes an elongated, horizontally disposed primary track.

Figures 5A, 5B, 5C:
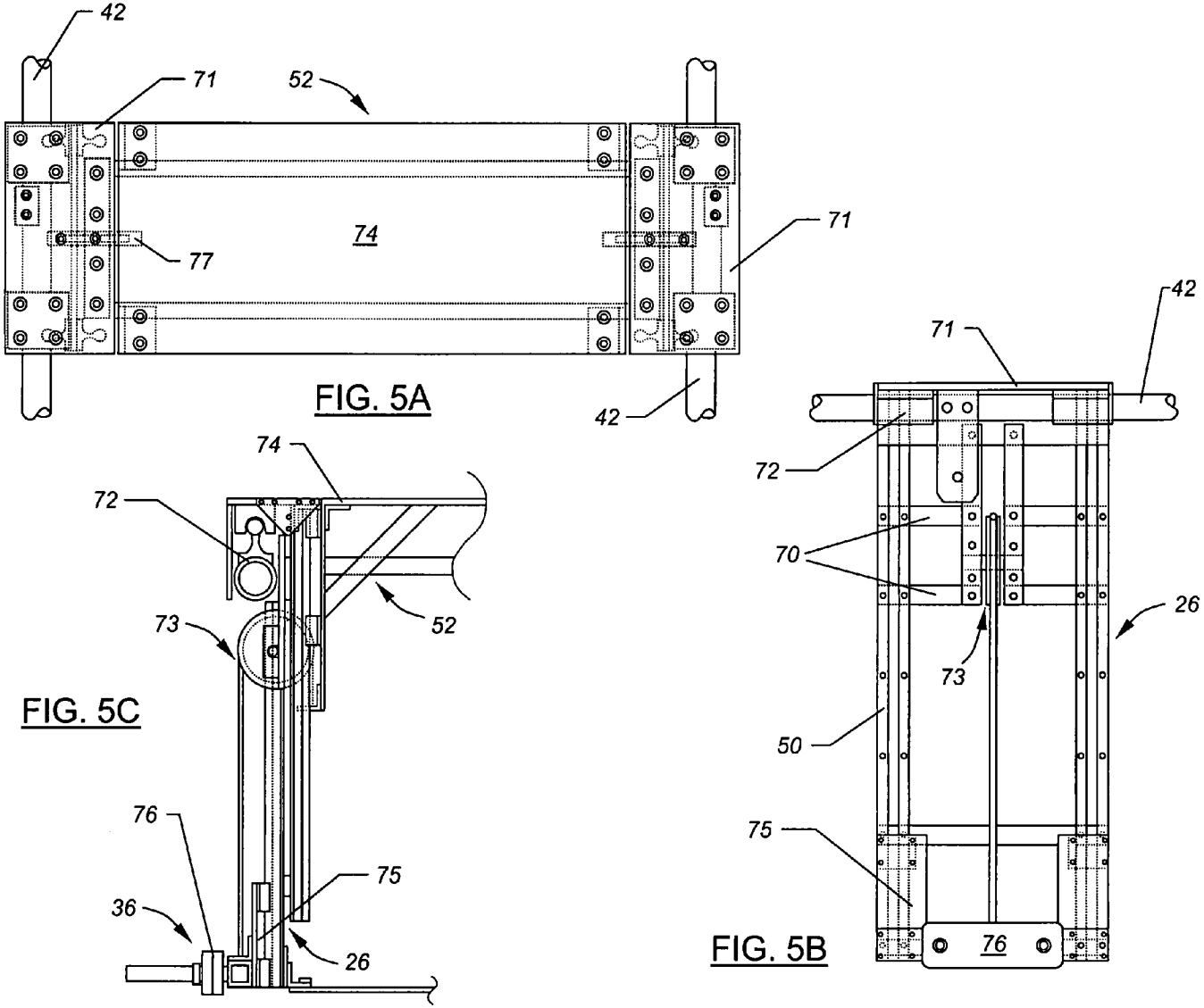
FIGS. 5A 5B are diagrammatic representations of a top view and side view, respectively generally illustrating as an example, an embodiment of a pelvic sled assembly and counterbalance force component.
FIG. 5C is a diagrammatic representation of a front left side view generally illustrating as an example, an embodiment of a pelvic sled assembly and counterbalance force component.

With reference to the embodiment illustrated in FIGS. 5A and 5B, the secondary track frame (26) is slideably mounted to the primary track members (42) and comprises a plurality of interconnected structural members (70), a plurality of elongated secondary track members (50) in parallel space relation supported by the plurality of interconnected structural members (70), and a plurality of top bearing plates (71) supported by the plurality of elongated secondary track members (50). Multiple embodiments for the secondary track frame exist such that the functionality of the secondary track frame remains. Further, multiple embodiments for the size and shape of the secondary track members exist. Any size and shape can be employed such that the functionality of the secondary track members remains. The secondary track frame comprises a means for translating the pelvic sled (32) and adjustable counterbalance force component (36) between the top end (27) and bottom end (28) of the secondary track frame. In an embodiment, a plurality of elongated secondary track members is one means for translating the pelvic sled (32) and adjustable counterbalance force component (36) between the top end (27) and bottom end (28) of the secondary track frame. In FIG. 5B, the secondary track frame (26) is substantially rectangular in shape. However, any shape may be used such that the pelvic sled can translate between the top end and bottom end of the secondary track frame. As stated earlier, the secondary track frame (26) is slideably mounted to the primary track frame (25) such that the secondary track frame (26) can translate in a longitudinal motion (30) relative to the base frame (22), wherein the longitudinal motion (30) is defined in FIGS. 2B and 3B. With continued reference to FIGS. 2B, 3B, 5A, and 5B, as an example, the secondary track frame (26) may be slideably mounted on the primary track frame (25) via a plurality of first track-engaging guides (72) supported on the plurality of top bearing plates (71). These first track-engaging guides (72) slide along the primary track frame (25) for longitudinal motion (30) to support and guide movement of the secondary track frame (26) between the front end (23) and rear end (24) of the base frame (22). In addition, rollers, linear bearings, air bearings, or other suitable means (not otherwise shown) may be used to slideably mount the secondary track frame (26) to the primary track frame (25). The secondary track means is a track means for supporting a reciprocally moving device. In another embodiment, the secondary track frame (26) may be adjustable relative to the base frame (22) and commensurate with the user's height. As an example, the secondary track frame (26) is adjustable along the primary track frame (25) via a screw thread arrangement actuated by a knob (not otherwise shown), as is commonly known in the art. As another example, the secondary track frame (26) may be adjustable along the primary track frame (25) via a latch actuated by a handle and spring mechanism (not otherwise shown), as is commonly known in the art. Although a substantially rectangular secondary track frame (26) is illustrated in FIG. 5B, all other shapes may be utilized such that a secondary track frame can translate in a longitudinal motion (30) relative to the base frame (22) and allow for translation of the pelvic sled (32) in a vertical motion (33) relative to the base frame (22). In still another embodiment, the secondary track frame (26) may be lockable in longitudinal translation. As an example, the secondary track frame (26) is lockable in longitudinal translation via at least one locking pin that engages appropriate apertures or detents.

Figure 3B:
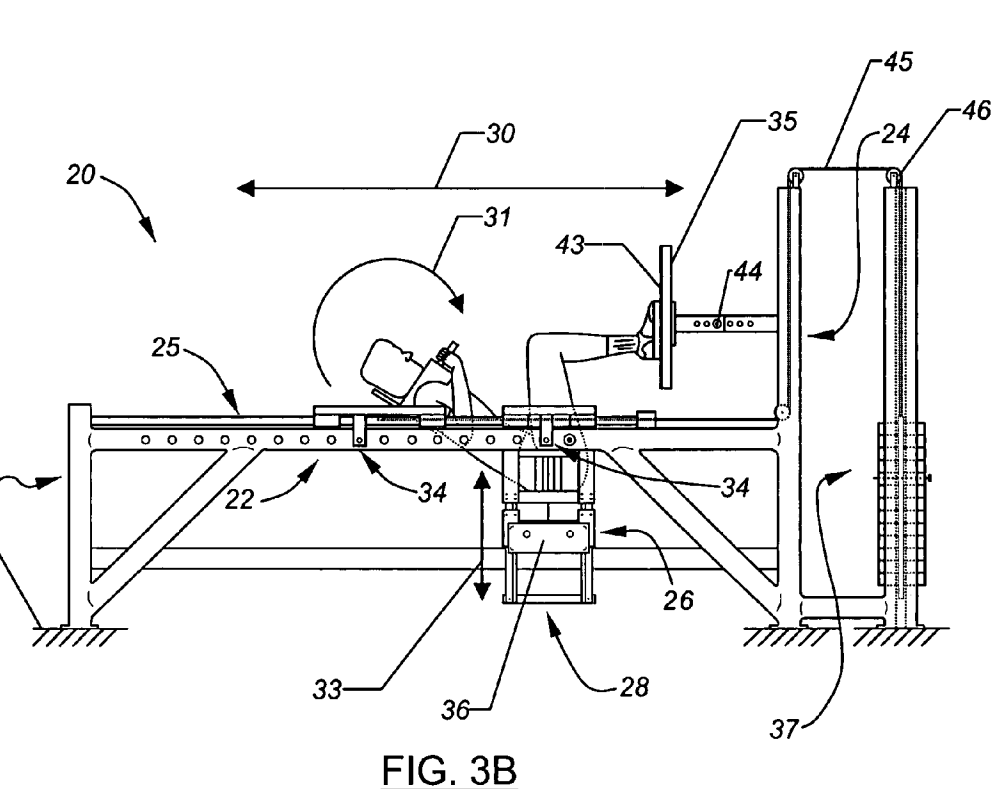
FIGS. 3A and 3B are diagrammatic representations of a top view and side view, respectively generally illustrating as an example, the embodiment of the apparatus as illustrated in FIGS. 2A and 2B showing a user disposed thereon in another stage of the squat exercise.
Figure 4A:
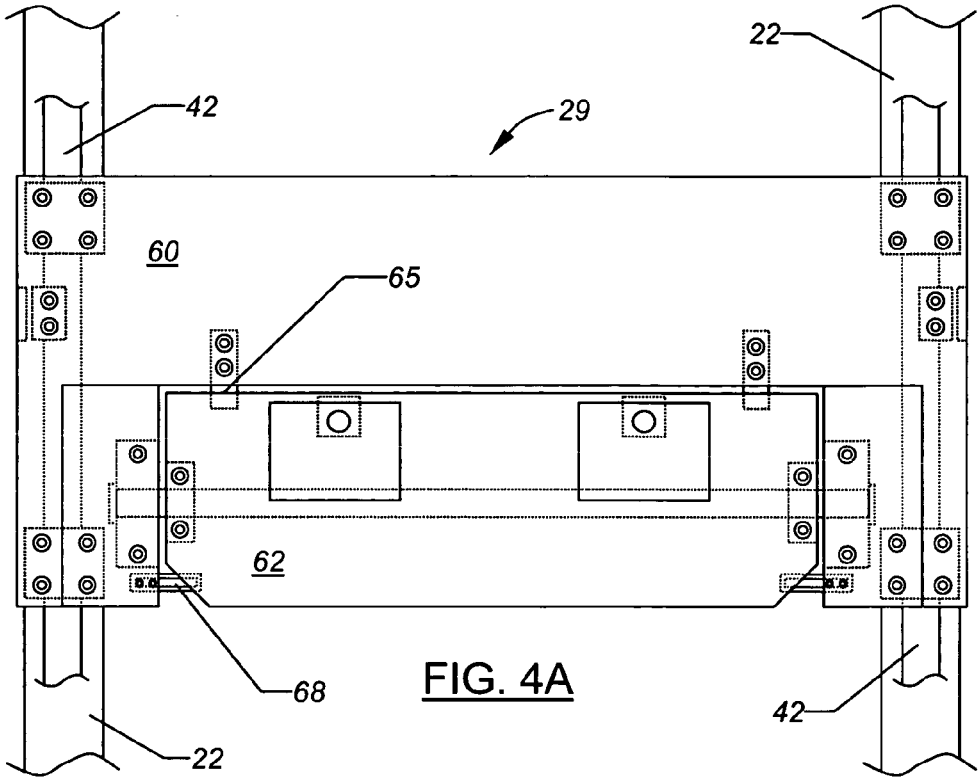
FIGS. 4A and 4B are diagrammatic representations of a top view and front view, respectively generally illustrating as an example, an embodiment of a shoulder sled.
Figure 4B:
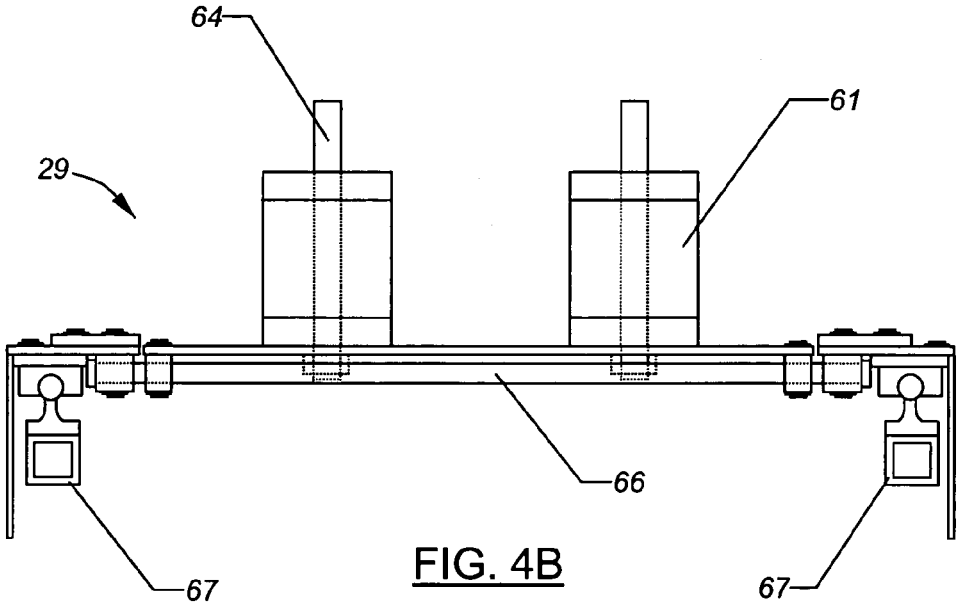
Figure 7B:
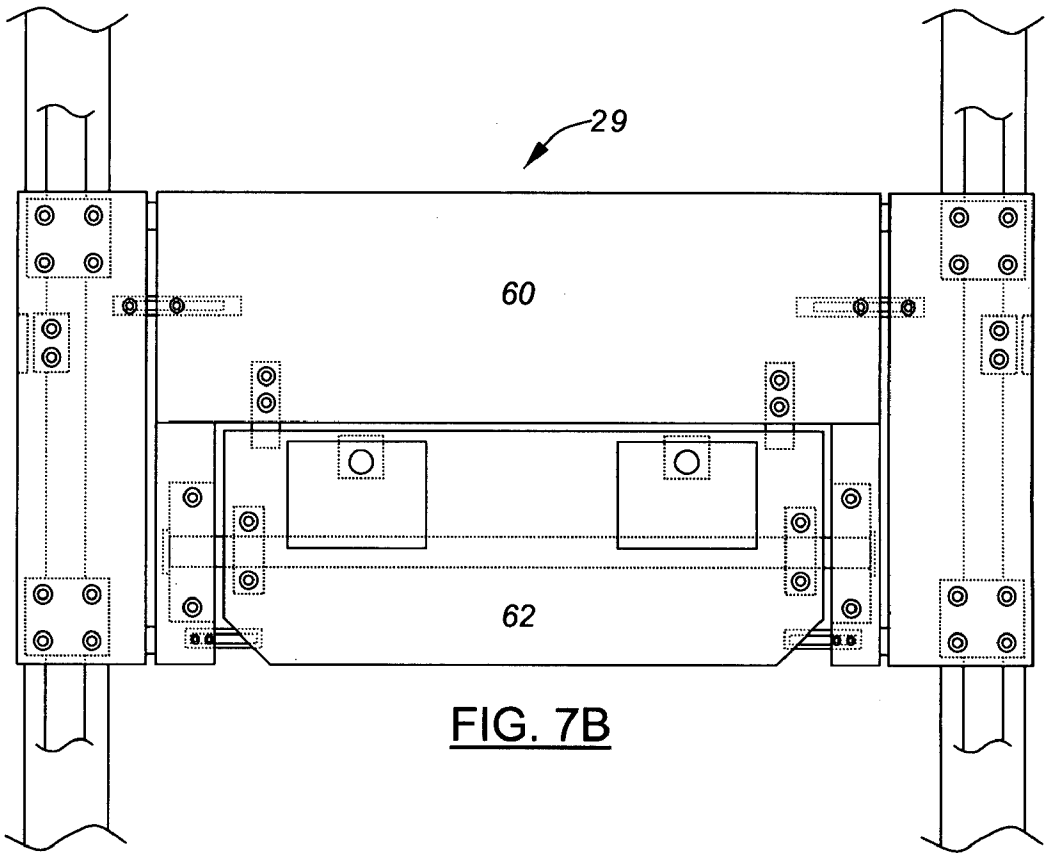
FIGS. 7A and 7B are diagrammatic representation of a front view and top view, respectively, generally illustrating a shoulder sled assembly capable of rotation as well as horizontal and vertical reciprocal movement.
Figure 7A:
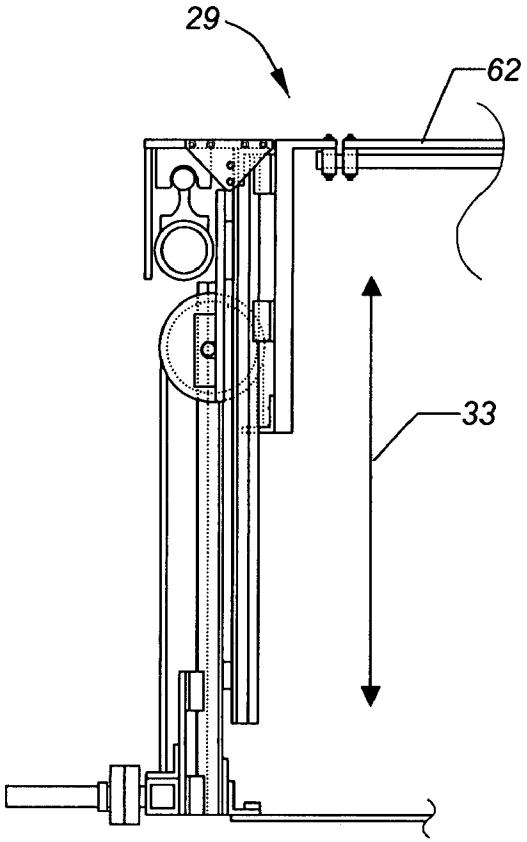

With reference to the embodiment illustrated in FIGS. 4A and 4B, the shoulder sled (29) comprises a translation means, slideably mounted to the primary track frame, for translating a user's shoulders and upper back in a longitudinal motion (30) relative to the base frame (22); and a rotation means, supported by the translation means, for rotating (31) the user's shoulders and upper back about the latitudinal axis as illustrated in FIGS. 2B and 3B. In an embodiment, the translation means is comprised of a substantially horizontal first plate (60) wherein the first plate (60) is slideably mounted to the primary track frame (25). As an example, the first plate (60) may be slideably mounted on the primary track frame (25) via a plurality of second track-engaging guides (67) supported on the first plate (60). These second track-engaging guides (67) slide along the primary track frame (25) for longitudinal motion (30) to support and guide movement of the shoulder sled (29) between the front end (23) and rear end (24) of the base frame (22). In addition, rollers, linear bearings, air bearings, or any other suitable means (not otherwise shown) may be included to slideably mount the first plate (60) to the primary track frame (25). Further, the first plate (60) may be padded for added comfort. In an embodiment, the rotation means is comprised of a substantially horizontal panel (62) supported by the first plate (60) in such a way as to allow rotation (31) of the panel (62) about the latitudinal axis. In an embodiment, the panel (62) is supported by a shaft (66), which is in turn, supported by the first plate (60). In an embodiment, the shaft (66) is supported to the underside of the panel (62) by brackets. In an embodiment, the ends of the shaft (66) are supported by rotational bearings affixed to the underside of the first plate (60). The shaft (66) rotates about the latitudinal axis, thereby allowing the panel (62) to rotate about the latitudinal axis. In another embodiment, the rotation means is further comprised of a pair of shoulder supports (61) attached to the panel (62) and a pair of handles (64) attached to the pair of shoulder supports (61). In an embodiment, the shoulder supports (61) may be padded, contoured to fit a user's shoulders, or both for added comfort. Further, the translation means may further comprise at least one first tilt catch (65) supported by the first plate (60), wherein the first tilt catch (65) is used to ensure that the panel (62) does not rotate too far in the counter-clockwise direction, wherein the clockwise direction is defined in FIGS. 2B and 3B (31). Further, the translation and rotation means defined above represent a shoulder sled means for supporting the user's shoulders and upper back and for reciprocally moving between the front end and rear end of the base frame while being disposed on the primary track frame. Still further, the rotation means may further comprise at least one second tilt catch (68) supported by the first plate (60), wherein the second tilt catch (68) is used to lock the shoulder sled (29) relative to rotational motion. The shoulder sled (29) may further comprise an attachment means for coupling itself to the adjustable exercise resistive force component (37). Said attachment means include items commonly used in the art such as brackets, nuts, bolts, or any other suitable means. In another embodiment, the shoulder sled (29) and shoulder sled means may be adjustable relative to the base frame (22) and commensurate with the user's height. As an example, the shoulder sled (29) and shoulder sled means are adjustable along the primary track frame (25) via a screw thread arrangement actuated by a knob (not otherwise shown), as is commonly known in the art. As another example, the shoulder sled (29) may be adjustable along the primary track frame (25) via a latch actuated by a handle and spring mechanism (not otherwise shown), as is commonly known in the art. In still another embodiment, the shoulder sled (29) and shoulder sled means may be lockable in longitudinal translation, rotation, or both. As an example, the shoulder sled (29) and shoulder sled means are lockable in translation via at least one locking pin that engages appropriate apertures or detents. In yet another embodiment, the shoulder sled and shoulder sled means may further comprise a padded headrest secured to the panel (62). The shoulder sled is a reciprocally moving and rotatable device. With reference to FIGS. 7A and 7B, in another embodiment, the shoulder sled (29) also allows for vertical motion (33) relative to the base frame (22), similar in operation and design to the pelvic sled assembly. In an embodiment, the panel (62) translates in vertical motion (33) and rotates (31) about the latitudinal axis as defined in FIGS. 2B and 3B. This vertical motion of the shoulder sled would allow an additional freedom of movement to recruit muscles and provide neurological training required for balance with respect to the point of support (i.e., the feet). In another embodiment (not otherwise shown), an exercise apparatus for supporting a user comprises a primary track frame comprising a plurality of longitudinal tracks and a shoulder sled assembly disposed on the primary track frame so that the shoulder sled assembly reciprocally moves along the primary track frame and wherein the shoulder sled assembly is rotatable.

Figure 8B:
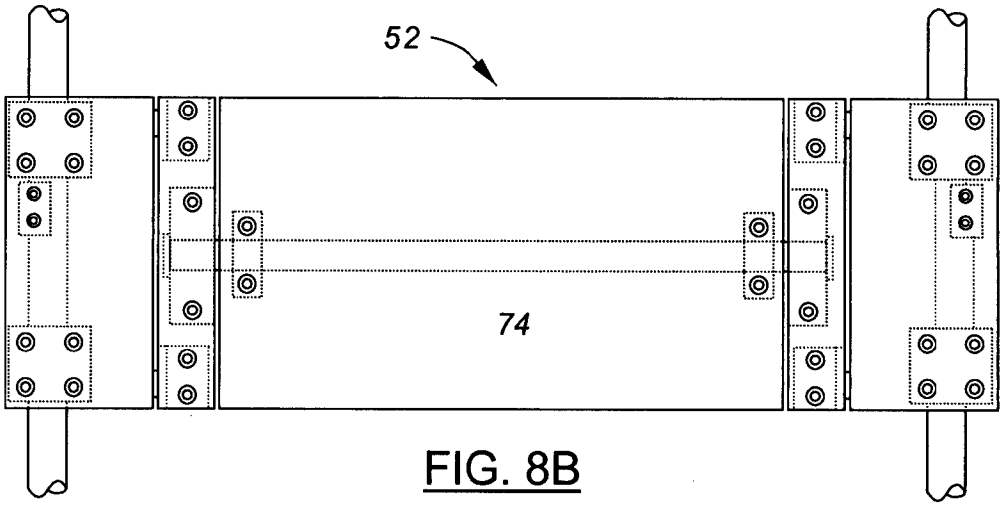
FIGS. 8A and 8B are diagrammatic representations of a front view and top view, respectively, generally illustrating a pelvic sled assembly capable of rotation as well as horizontal and vertical reciprocal movement.
Figure 8A:
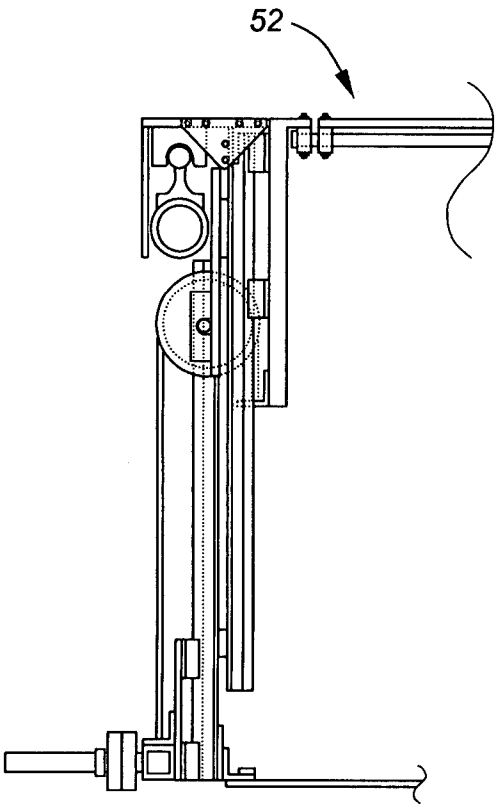

With reference to the embodiment illustrated in FIGS. 5A, 5B, and 5C, the pelvic sled (32) comprises a moveable seat assembly (52) slideably mounted to the secondary track frame (26) and coupled to the adjustable counterbalance force component (36). The moveable seat assembly (52) slideably mounted to the secondary track frame (26) and coupled to the adjustable counterbalance force component (36) is a pelvic sled means for supporting the user's hips and for reciprocally moving between the top and bottom end of the secondary track frame while being disposed on the secondary track frame. Also, the pelvic sled (32) and secondary track frame (26) may be referred to as a "pelvic sled assembly." The seating area (74) of the moveable seat assembly (52) is substantially flat in FIG. 5A but may be padded, contoured to fit a user's pelvic region, or both for added comfort. The pelvic sled (32) and pelvic sled means may further comprise a strap (not otherwise shown) attached to the seat assembly (52) to secure the user's pelvic region during the course of an exercise. The pelvic sled is a reciprocally moving device. Further, as defined above, the pelvic sled assembly is a reciprocally moving device. In still another embodiment, the pelvic sled (32) and pelvic sled means may be lockable in vertical translation. As an example, the pelvic sled (32) and pelvic sled means are lockable in vertical translation via a pelvic sled tilt catch (77). As another example, the pelvic sled (32) and pelvic sled means are lockable in vertical translation via at least one locking pin that engage appropriate apertures or detents (not otherwise shown). With reference to FIGS. 8A and 8B, in another embodiment, the seat assembly (52) of the pelvic sled may also be allowed to rotate via bearings or other suitable means to further facilitate rotation of the user's pelvis during the exercise motion. In still another embodiment, an exercise apparatus, supporting a user, comprises a primary track frame comprising a plurality of first longitudinal tracks, a secondary track frame comprising a plurality of second longitudinal tracks wherein the secondary track frame is disposed on the primary track frame so that the secondary track frame reciprocally moves along the primary track frame and the second longitudinal tracks are not in parallel space relation relative to the first longitudinal tracks, and a pelvic sled disposed on the secondary track frame so that the pelvic sled reciprocally moves along the secondary track frame wherein the pelvic sled supports the user's pelvic area. In yet another embodiment, the pelvic sled in the previous embodiment is rotatable.

With continued reference to the embodiment illustrated in FIGS. 2A and 2B, the foot plate (35) is supported by the base frame (22) and provides a stationary support so that the shoulder sled (29), secondary track frame (26), and pelvic sled (32) are all displaced when the user (21) pushes his/her feet against the foot plate (35). The foot plate (35) comprises a base foot support platform and a non-slip surface (43) attached to the base support platform. Further, the foot plate (35) may be adjustable relative to the base frame (22) and commensurate with the user's height. The adjusting means comprises a foot plate locking pin (44) that engages appropriate apertures or detents incorporated in the base foot support platform. The foot plate (35) may comprise a plurality of sections (not otherwise shown). Further, wherein the foot plate is comprised of a plurality of sections, each section may be disposed at a different angle to allow for different variations of a particular exercise (not otherwise shown). The foot plate may be shaped, such as in a C shaped channel.

With continued reference to the embodiment illustrated in FIGS. 5B and 5C, the adjustable counterbalance force component (36) is comprised of a counterbalance sled (75) and at least one weight (76) wherein the counterbalance sled is slideably mounted to the secondary track frame (26) and coupled to the pelvic sled (32). In an embodiment, the adjustable counterbalance force component (36) is coupled to the pelvic sled (32) via a pulley and cable system (73) and suitable attachment means and thus, the pelvic sled (32) and counterbalance force component (36) move in opposite directions as the user displaces the pelvic sled (32). In an embodiment, the counterbalance force component (36) is slideably mounted to the secondary track frame (26) and coupled to the pelvic sled (32) so that the adjustable counterbalance force component (36) and pelvic sled (32) reciprocally move in opposite directions during an exercise. The adjustable counterbalance force component (36) is further supported by the secondary track frame (26), but in alternative embodiments, the adjustable counterbalance force component may be supported by the base frame or in a separate frame. The proper counterbalance force for a given user is commensurate with the user's weight. The purpose of the counterbalance is to offset a portion of the user's total weight such that the user's pelvic area is supported, but can freely move in vertical translation during the course of a squat exercise. Multiple types of adjustable counterbalance force components may be employed. For example, a counterbalance sled and at least one weight, such as free weights (as illustrated in FIG. 5C) or in a weight rack is one adjustable counterbalance force means for providing an exercise force commensurate with the strength of the user and the desired intensity of the exercise being performed. An electric motor is a second adjustable counterbalance force means for providing an exercise force commensurate with the strength of the user and the desired intensity of the exercise being performed. A counterbalance sled and at least one bungee cord represent a third adjustable counterbalance force means for providing an exercise force commensurate with the strength of the user and the desired intensity of the exercise being performed. A counterbalance sled and at least one spring represents a fourth adjustable counterbalance force means for providing an exercise force commensurate with the strength of the user and the desired intensity of the exercise being performed. All of the various embodiments for a counterbalance force means are coupled to the pelvic sled such that the counterbalance force means provides a counterbalance force to the pelvic sled while allowing vertical translation (33) (wherein vertical translation is defined in FIGS. 2B and 3B).

With continued reference to the embodiment illustrated in FIGS. 2B and 3B, at least one adjustable resistive exercise force component (37) is coupled to the shoulder sled (29) so that the at least one adjustable exercise resistive force component (37) enables an exercise force commensurate with the strength of the user and the desired intensity of the exercise being performed. FIGS. 2B and 3B illustrate the adjustable resistive exercise force components (37) affixed at one longitudinal end of the base frame (22). However, the adjustable resistive exercise force components (37) can be placed in any position relative to the base frame (22), such as affixed to the user's right or left side or on the opposite longitudinal end closest to the user's head. In another embodiment, at least one adjustable resistive exercise force component may be used. Multiple types of adjustable resistive exercise force components may be employed. For example, a weight rack, as illustrated in FIGS. 2B and 3B, is one adjustable exercise resistive force means for providing an exercise force commensurate with the strength of the user and the desired intensity of the exercise being performed. A plurality of elastic bands is a second adjustable exercise resistive force means for providing an exercise force commensurate with the strength of the user and the desired intensity of the exercise being performed. A plurality of bows is a third adjustable exercise resistive force means for providing an exercise force commensurate with the strength of the user and the desired intensity of the exercise being performed. A plurality of springs is a fourth adjustable exercise resistive force means for providing an exercise force commensurate with the strength of the user and the desired intensity of the exercise being performed. A vacuum and flywheel system is a fifth adjustable exercise resistive force means for providing an exercise force commensurate with the strength of the user and the desired intensity of the exercise being performed. Free weights and ancillary structure required to mount the free weights are a sixth adjustable exercise resistive force means for providing an exercise force commensurate with the strength of the user and the desired intensity of the exercise being performed. Again, the examples above illustrate the variety of embodiments available for the adjustable resistive exercise force component.

Figure 6:
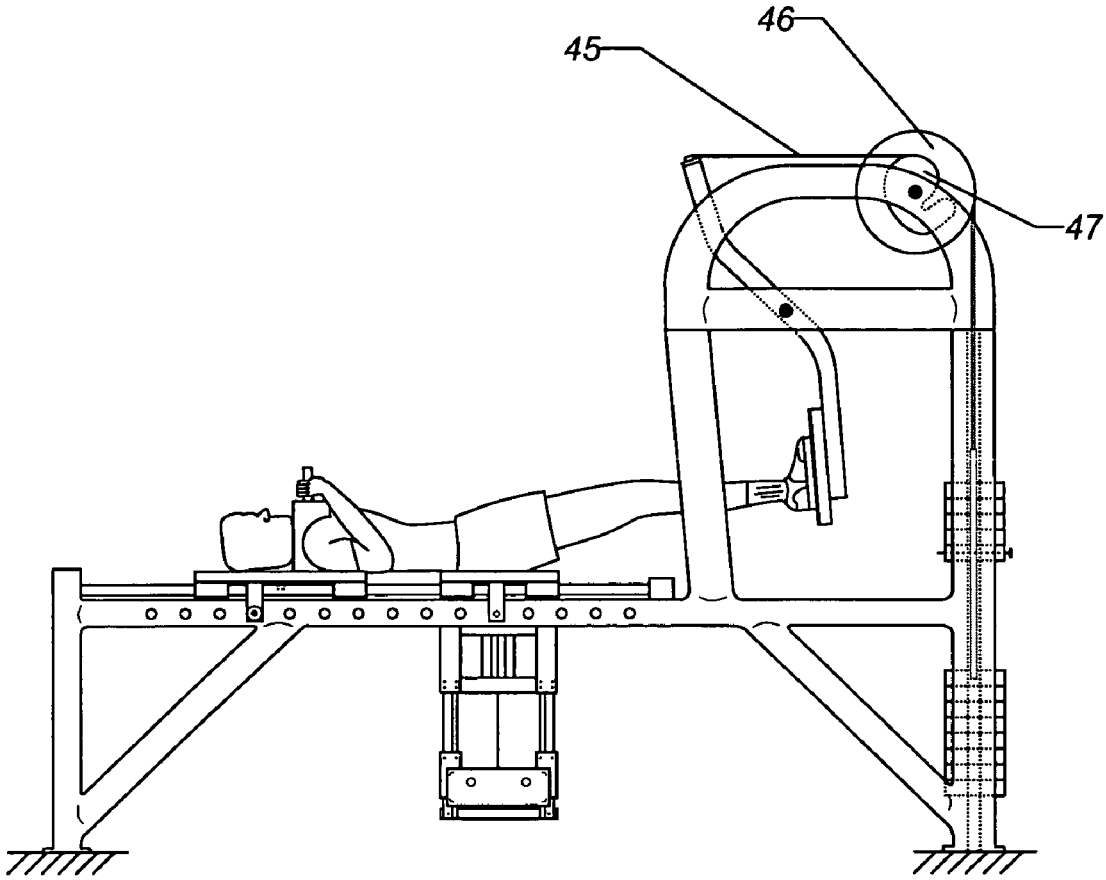
FIG. 6 is a diagrammatic representation of a side view generally illustrating as an example, an embodiment of the apparatus incorporating a moveable foot plate showing a user disposed thereon in one stage of a squat exercise.

As a further example, wherein at least one adjustable exercise resistive force component (37) is a weight rack such as is commonly known in the art, the weight rack includes a pair of elongated vertically disposed tube members extending upwardly in parallel space relation. An upper and lower cross-bar extends across the tops and bottoms, respectively, of the weight rack tube members for stability. Further, as is known in the art for weight racks, a pair of elongated vertically disposed guide bars extend upwardly in parallel spaced relation symmetrically between the weight stack tube members. The guide bars are secured to the upper and lower cross-bars via, for example, nuts and the like. The guide bars support a plurality of weights in a weight stack so the weights slide up and down the guide bars when the various embodiments of the apparatus are in use as described herein. A center bar extends through the center of each of the plurality of weights in the weight stack and is secured at the center bar's bottom end to the lower cross-bar. The center bar has a plurality of holes corresponding in position to the position of a weight in the weight stack. Furthermore, each of the plurality of weights has a hole in which the user can insert a selector pin though the center bar hole and weight hole thereby selecting a weight commensurate with the user's strength and desired intensity of the exercise. Coupling of the weight rack (or any other adjustable resistive force means) can be accomplished by multiple means. For example, as illustrated in FIG. 6, at least one cable (45), at least one pulley (46), at least one cam (47) and attachment means commonly known in the art can be used in any combination to couple the uppermost weight of the weight stack, center bar, or both to a moveable foot plate. As another example (not otherwise shown), at least one chain, at least one pulley, at least one cam, and attachment means commonly known in the art can be used in any combination to couple the uppermost weight of the weight stack, center bar, or both to a moveable shoulder sled. Further, for example, at least one belt, at least one pulley, at least one cam, and attachment means commonly known in the art can be used in any combination to couple the uppermost weight of the weight stack, center bar, or both to a moveable shoulder sled. The weight stack may be supported by the base frame or contained in a separate frame secured to the base frame. In addition, resilient shock absorbing members may be disposed between the lowermost weight in the weight stack and lower cross-bar to reduce the impact when the weights are lowered, as may be the case.

An exercise apparatus in accordance with another embodiment of the present invention is similar to the embodiment illustrated in FIGS. 2A and 2B. However, as illustrated in FIG. 6, in another embodiment, the shoulder sled remains fixed and the foot plate reciprocally moves during the exercise motion. The shoulder sled still provides a means for rotation so that the user's upper back and shoulders rotate during the exercise motion. In this embodiment, there is no requirement for the shoulder sled to be supported by the primary track system and instead, the shoulder sled may be supported by the base frame. Notwithstanding the previous statement, the shoulder sled may be supported by the primary track system. Further, in this embodiment, the shoulder sled is not coupled to the adjustable resistive exercise force component. The foot plate is mounted to the base frame and translates in a generally longitudinal motion during the course of an exercise. Further, the foot plate, rather than the shoulder sled, is coupled to the adjustable resistive exercise force component.

Figure 3A:
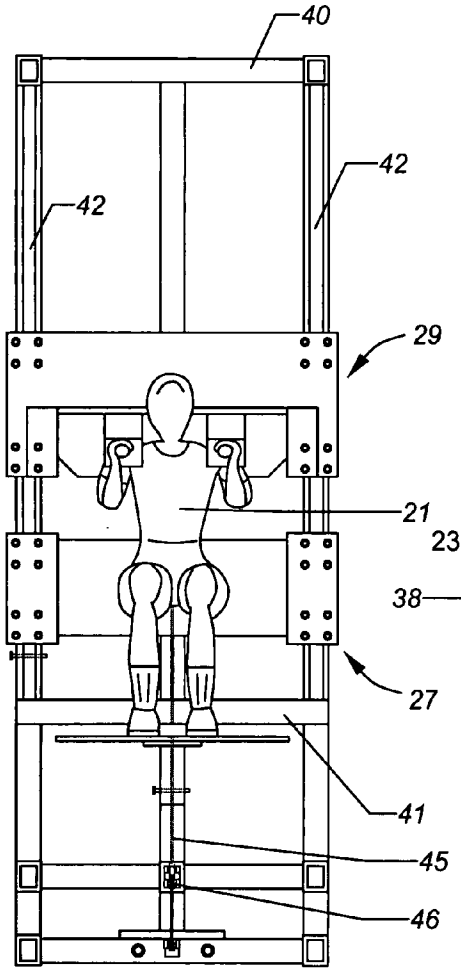

Multiple methods exist for using the various embodiments described above. For example, with continued reference to FIGS. 2A and 2B as well as FIGS. 3A and 3B, in one method wherein the user (21) desires to simulate a free-weight squat exercise, the user (21) first selects a "warm-up" weight from the adjustable resistive exercise force component (37) via a selector pin (not otherwise shown). The shoulder sled (29) and pelvic sled (32) are in position on the primary track frame (25) conducive for the user (21) to position himself/herself in the apparatus (20). The user (21) next positions himself/herself in the apparatus (20). The user (21) adjusts the shoulder sled (29) in a "start" position as shown in FIGS. 3A and 3B via a pin assembly. The "start" position is defined such that the user's thighs are substantially parallel to the foot plate (35) and the user's upper back is at an angle consistent with $\theta_2$ in FIG. 1C, when the user (21) is positioned in the apparatus (20). The shoulder and upper back of the user (21) are disposed on the shoulder sled (29) and the user's shoulders are engaged with the pair of shoulder supports (61). The user's head is comfortably engaged with the panel (62) of the shoulder sled (29), wherein the panel (62) includes a headrest (65). The user's pelvic region is comfortably engaged on the pelvic sled (32). A strap (not otherwise shown) may be used to snugly strap the user (21) to the pelvic sled (32). Further, a safety locking means is used to support the load selected from the adjustable resistive exercise force component (37) when the user (21) is in the "start" position and prevent the user (21) from going past a predetermined angle consistent with $\theta_2$ in FIG. 1C.

The user (21) positions his/her feet on the foot plate (35). The user (21) is ready to begin a simulated free-weight squat exercise. The user (21) pushes with his/her feet against the foot plate (35) so that the shoulder sled (29), secondary track frame (26), and pelvic sled (32) are simultaneously displaced in a smooth, controlled, coordinated movement. During this movement, the upper back of the user changes its angle from an angle consistent with $\theta_2$ in FIG. 1C to a position wherein the user's upper back is substantially perpendicular relative to the foot plate (35). Further, during this movement, the adjustable resistive exercise force component (37) provides the selected resistance to the user. Still further, during this movement, the counterbalance force component (36) provides the appropriate counterbalance force against the user's pelvic region commensurate with the user's weight necessary for proper simulation of a free-weight squat exercise. The user (21) holds this position as shown in FIGS. 2A and 2B for a predetermined amount of time.

The user (21) pushes his/her feet against the foot plate (35) in such as way to reduce the reaction force he/she is applying against the adjustable resistive exercise force component (37) through the foot plate (35). Thus the user (21) returns to the "start" position in a smooth, controlled, coordinated movement. Upon reaching the "start" position, the user (21) holds this position for a predetermined amount of time before beginning another exercise cycle.

In another method, the position as illustrated in FIG. 2B represents the "start/stop" position. The position as illustrated in FIG. 3B represents a "midpoint" position. The shoulder sled (29) is locked via a safety locking means in the "start/stop" position such that a resistive force or load can be applied without the user having to support the load as it is applied. When the user is ready to begin the exercise, the shoulder sled (29) is unlocked and the user accepts the resistive force.

There has thus been described multiple embodiments of an apparatus for duplicating a user's movements when performing a simulated free-weight squat exercise. In the embodiments illustrated in the above methods of use, the user is in a horizontal, supine position rather than in a vertical position. However, as mentioned earlier, various embodiments of the apparatus will position the user in a vertical or inclined position as the exercise is performed.

The various embodiments of the apparatus differ from other apparatus for performing like exercises in that it does not force the exerciser's back to remain straight or restricted to a predetermined path, but rather, allows the user's upper back to change in angularity based on the user's proportions and the user's active recruitment of muscles to maintain appropriate exercise posture and form as the exercise is being performed. The advantage of the apparatus of the type described will be readily appreciated.

With the above description of the invention in mind, reference is made to the claims appended hereto for a definition of the scope of the invention.

What is claimed is:

1. An exercise apparatus for supporting a user said exercise apparatus comprising:

a primary track frame comprising a plurality of first longitudinal tracks;

a secondary track frame comprising a plurality of second longitudinal tracks wherein said secondary track frame is disposed on said primary track frame wherein said secondary track frame is capable of reciprocally moving along said primary track frame and said second longitudinal tracks are not in parallel space relation relative to said first longitudinal tracks;

a shoulder sled assembly disposed on said primary track frame wherein said shoulder sled assembly is capable of reciprocally moving along said primary track frame during an exercise and wherein the shoulder sled assembly is capable of rotating during said exercise; and a pelvic sled disposed on said secondary track frame wherein said pelvic sled is capable of reciprocally moving along said secondary track frame contemporaneously with said movement of said secondary track frame during said exercise wherein said pelvic sled supports said user's pelvic area.

2. The exercise apparatus as described in claim 1, wherein said pelvic sled is capable of rotating during said exercise.

3. The exercise apparatus as described in claim 2, wherein said pelvic sled is capable of rotating about a latitudinal axis extending from the right side of said pelvic sled through the left side of said pelvic sled.

4. The exercise apparatus as described in claim 1, further comprising an adjustable counterbalance force component coupled to said pelvic sled and disposed on said secondary track frame wherein said adjustable counterbalance force component is capable of moving along said secondary track frame and reciprocally moveable along said secondary track frame in opposite direction to said pelvic sled during said exercise.

5. The exercise apparatus as described in claim 1, wherein said shoulder sled is capable of rotating about a latitudinal axis extending from the right side of said shoulder sled through the left side of said shoulder sled.

6. The exercise apparatus as described in claim 1, further comprising a surface engaging base frame having a front end and rear end wherein said base frame supports said primary track frame between said front end and rear end of said base frame.

7. The exercise apparatus as described in claim 6, wherein said shoulder sled is reciprocally moveable between said front end and rear end of said base frame in longitudinal translation and wherein said user's shoulders engage said shoulder sled and wherein said shoulder sled allows longitudinal translation of said user's shoulders and upper back between said front end and rear end of said base frame and wherein said shoulder sled allows rotation of said user's shoulders and upper back relative to said base frame during said exercise, and wherein said secondary track frame has a top end and bottom end, wherein said pelvic sled is reciprocally moveable between said top end and bottom end of said secondary track frame in vertical translation, and wherein the combined motion of said pelvic sled and said secondary track frame allows the user's hips to freely move in longitudinal and vertical translation.

8. The exercise apparatus as described by claim 7, wherein said shoulder sled is adjustable relative to said base frame and commensurate with said user's height.

9. The exercise apparatus as described by claim 7, wherein said shoulder sled is selectively lockable in rotation, longitudinal translation, or both.

10. The exercise apparatus as described by claim 7, wherein said secondary track frame is adjustable relative to said base frame and commensurate with said user's height.

11. The exercise apparatus as described by claim 7, wherein said secondary track frame is selectively lockable in longitudinal translation.

12. The exercise apparatus as described by claim 7, further comprising an adjustable counterbalance force component coupled to said pelvic sled so that said counterbalance force component is adjustable to be commensurate with said user's weight and offsets said user's weight as said user's hips move on said pelvic sled in vertical translation.

13. The exercise apparatus as described by claim 12, wherein said adjustable counterbalance force component is slideably mounted to said secondary track frame and is reciprocally moveable along said secondary track frame in opposite direction to said pelvic sled during an exercise.

14. The exercise apparatus as described by claim 12, wherein said adjustable counterbalance force component is supported by said secondary track frame.

15. The exercise apparatus as described by claim 12, further comprising a foot plate supported by said base frame so that said user's feet engage said foot plate and so that said shoulder sled, said secondary track frame, and said pelvic sled are all displaced upon said user pushing with his/her feet against said foot plate.

16. The exercise apparatus as described by claim 15, wherein said foot plate is comprised of a base foot plate supported by said base frame and a non-slip surface treatment attached to said base foot plate.

17. The exercise apparatus as described by claim 15, wherein said foot plate is adjustable relative to said base frame and commensurate with said user's height.

18. The exercise apparatus as described by claim 15, further comprising at least one adjustable exercise resistive force component coupled to said shoulder sled so that said at least one adjustable exercise resistive force component enables an exercise force commensurate with the strength of said user and the desired intensity of the exercise being performed.

19. The exercise apparatus as described by claim 18, wherein said adjustable exercise resistive force component is supported by said base frame.

20. An exercise apparatus for supporting a user said exercise apparatus comprising:

a primary track frame supported by said base frame between said front end and rear end of said base frame;

a secondary track frame disposed on said primary track frame so that said secondary track frame is reciprocally moveable between said front end and rear end of said base frame in longitudinal translation and having a top end and bottom end;

a shoulder sled means for supporting said user's shoulders and upper back and for reciprocally moving along said primary track frame during an exercise and wherein said user's shoulders engage said shoulder sled means and wherein said shoulder sled means allows longitudinal translation of said user's shoulders and upper back between said front end and rear end of said base frame and wherein said shoulder sled means allows rotation of said user's shoulders and upper back relative to said base frame during said exercise; and a pelvic sled means for supporting said user's hips and for reciprocally moving between said top end and bottom end of said secondary track frame in vertical translation contemporaneously with said movement of said secondary track frame during said exercise while being disposed on said secondary track frame and wherein the combined motion of said pelvic sled means and said secondary track frame allows the user's hips to freely move in longitudinal and vertical translation during said exercise.

21. The exercise apparatus as described by claim 20, further comprising:

a surface engaging base frame having a front end and a rear end wherein said base frame supports said primary track frame between said front end and rear end.

22. The exercise apparatus as described by claim 21, further comprising a foot plate supported by said base frame so that said user's feet engage said foot plate and so that said shoulder sled means, said secondary track frame, and said pelvic sled means are all displaced upon said user pushing with his/her feet against said foot plate.

23. The exercise apparatus as described by claim 22, further comprising an adjustable counterbalance force means for offsetting said user's weight as said user's hips move on said pelvic sled means in longitudinal and vertical translation upon said user pushing with his/her feet against said foot plate and wherein said adjustable counterbalance force means is supported by said secondary track frame.

24. The exercise apparatus as described by claim 23, further comprising a first coupling means for coupling said pelvic sled means to said adjustable counterbalance force means so that said adjustable counterbalance force means is engaged upon said user pushing with his/her feet against said foot plate.

25. The exercise apparatus as described by claim 22, further comprising at least one adjustable exercise resistive force means for providing an exercise force to said user commensurate with the strength of said user and the desired intensity of the exercise being performed as said user's shoulders rotate and longitudinally translate on said shoulder sled means upon said user pushing with his/her feet against said foot plate and wherein said adjustable exercise resistive force means is fixedly supported by said base frame.

26. The exercise apparatus as described by claim 25, further comprising a second coupling means for coupling said shoulder sled means to said adjustable exercise resistive force means so that said adjustable exercise resistive force means is engaged upon said user pushing with his/her feet against said foot plate.

* * * * *